United States Patent [19]

Jessop et al.

[11] Patent Number: 4,793,074

[45] Date of Patent: Dec. 27, 1988

[54] DRYER ASSEMBLY FOR PHOTOGRAPHIC PAPER

[75] Inventors: Thomas C. Jessop, Webster; Ralph L. Piccinino, Jr., Rush, both of N.Y.

[73] Assignee: Eastman Kodak Company, Rochester, N.Y.

[21] Appl. No.: 141,644

[22] Filed: Jan. 7, 1988

[51] Int. Cl.[4] ..... F26B 13/00

[52] U.S. Cl. ..... 34/160

[58] Field of Search ..... 34/151, 152, 155, 160

[56] References Cited

U.S. PATENT DOCUMENTS

| | | | |
|---|---|---|---|
| 3,434,225 | 3/1969 | Knibiehly | 34/160 |
| 3,510,960 | 1/1972 | Kubodera | 34/155 |
| 3,634,040 | 9/1974 | Russell et al. | 34/160 |
| 3,660,911 | 5/1972 | Buckingham | 34/160 |
| 3,800,434 | 4/1974 | Edgington et al. | 34/155 |
| 4,024,649 | 5/1977 | Gaskell | 34/155 |
| 4,132,013 | 1/1979 | Ferrarell | 34/155 X |
| 4,135,312 | 1/1979 | Hope et al. | 34/155 X |
| 4,292,745 | 10/1981 | Caratsch | 34/156 |
| 4,377,331 | 3/1983 | Seelenbinder et al. | 354/300 |
| 4,693,014 | 9/1987 | Caflisch et al. | 34/155 X |

*Primary Examiner*—Steven E. Warner

*Attorney, Agent, or Firm*—James A. Smith

[57] ABSTRACT

Apparatus for transporting and drying photographic paper which has been chemically processed, includes a roller assembly for transporting the paper through a drying tank. Drying of the paper is accomplished by means of warm air which is propelled by a pump through a distribution duct network. The duct network includes a number of distribution tubes each of which has a tube body and a discharge chute for directing the air from the tube against the paper. Contoured upper and lower surfaces of the tube in combination with individual roller elements, which are spaced apart on a roller shaft, provide turbulence reducing return channels for routing the air, which has been deflected by the paper, back toward the pump.

4 Claims, 4 Drawing Sheets

DRYER ASSEMBLY FOR PHOTOGRAPHIC PAPER

TECHNICAL FIELD

The present invention pertains to apparatus for drying photographic paper after the paper has been processed chemically to develop a latent image thereon.

BACKGROUND OF THE INVENTION

For the automatic development of a photographic image onto paper, there is available what is commonly known as a "developing minilab" which consists of a small, self contained work station which has the capability of forming a latent image of desired size and orientation from a negative onto photographic paper. The minilab chemically develops this latent image in permanent form onto the paper. The development of the latent image is typically accomplished by a number of individual chemical baths located inside the minilab which contain developer, bleach-fixer, and stabilizer. At the conclusion of the chemical processing, the photographic paper is automatically dried and then discharged from the machine for delivery to the customer.

The drying operation is typically accomplished by blowing air onto the surfaces of the paper to disburse the liquid chemicals as well as to increase their rate of evaporation. It is important, however, that the flow of air across the paper be relatively uniform to avoid generating streaks on the paper. It is further important to maintain the air velocity across the paper at a sufficient level to provide for adequate dispersion and evaporation of the liquid.

A number of conventional dryer units have been disclosed. For example, Edgington, et al., in U.S. Pat. No. 3,800,434, discloses a film dryer assembly which utilizes a number of segmented rollers for transporting the film past a plurality of air outlet nozzles.

In addition, a dryer nozzle having a cross sectional area which decreases in size along its length in order to provide a uniform air flow, is disclosed by Caratsch in U.S. Pat. No. 4,292,745.

And further, in U.S. Pat. No. 4,377,331 by Seelenbinder, et al. there is disclosed a blower housing for removing contaminated gases from a copier machine.

SUMMARY OF THE INVENTION

The present invention pertains to apparatus for transporting and drying photographic paper in a drying tank, such as typically contained in a developing minilab. The apparatus includes roller means for transporting the paper through the tank. The roller means includes first and second upper rollers which are spaced apart by a horizontal gap. There are also provided first and second lower rollers which are also spaced apart by a horizontal gap. The upper rollers include outer paper engaging surfaces which are spaced apart from paper engaging surfaces of the lower rollers by a vertical gap.

Also provided are air distribution means for directing air against the surface of the paper. The air distribution means includes pump means for propelling the air, as well as duct means which are in communication with the pump means, for directing the air from the pump means to locations inside the tank. The duct means includes an air tube having curved upper and lower surfaces, which combination preferably has an elliptical cross section. The duct means also includes a discharge chute which is integral to the air tube and which is positioned in the vertical gap between the upper and lower rollers, for directing air from the air tube against the paper. The surfaces of the discharge chute in combination with the curved upper and lower surfaces of the air tube as well as the horizontal gaps between the rollers, provide upper and lower return outlets for directing air which has been deflected from the paper in a path for return to the pump means.

It is therefore an object of the present invention to provide apparatus for drying photographic paper.

BRIEF DESCRIPTION OF THE DRAWINGS

These and other objects and advantages of the present invention will become more readily apparent upon reading the following detailed description in conjunction with the attached drawings, in which.

DETAILED DESCRIPTION OF THE INVENTION

As mentioned somewhat briefly in the Background of the Invention, the use of an automatic processor to develop a latent image onto photographic paper typically involves transporting the paper through a number of different chemical processing tanks. Located inside each tank is a removable roller assembly for automatically transporting the paper down towards the bottom of the tank, and then back upwards toward the top of the tank, thereby insuring exposure of the entire area of the paper to the processing chemicals. Automatic transfer of the paper between adjacent tanks is typically accomplished by a number of upper cross-over roller assemblies which first engage the paper as it nears the top of the tank, transport the paper over to the adjacent tank, and then feed the paper down into the roller assembly belonging to the adjacent tank. At the end of the chemical processing, there is a normally a dryer tank which contains its own roller assembly for transporting the paper in a similar manner through the drying tank.

Figure 1:
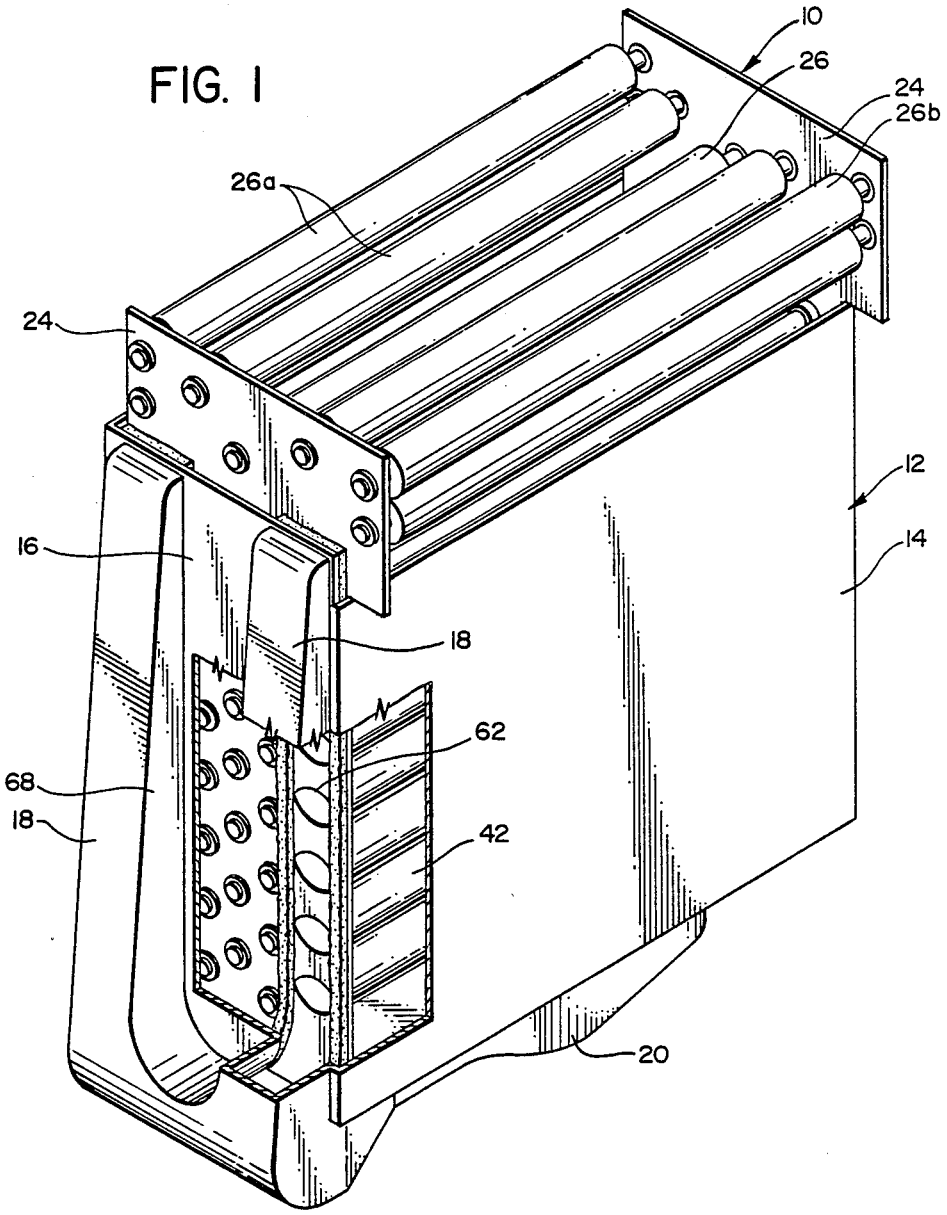
FIG. 1 is an isometric view of the dryer assembly of the present invention.

Having provided additional background to the present invention, attention now will be turned to the details of the invention. Referring first to FIG. 1 there is shown a dryer roller assembly indicated at 10 removably contained in a dryer tank indicated at 12 and which is cut away to show the roller assembly inside. The dryer tank 12 includes a front wall 14, rear wall 15 (FIG. 2), a left side wall 16 (FIG. 1) to which there are attached two upwardly extending air ducts 18, and a right side wall 19 (FIG. 3). Further air ducting is provided by a bottom duct 20 which is in communication with the left end ducts 18 for directing air from below the roller assembly 10 and upward into the tank.

Turning now to the roller assembly 10 (FIG. 1), it is formed by a pair of upstanding and parallel left, right end plates 24 which support therebetween a plurality of lengthwise extending paper feed rollers 26 which are rotated in a conventional manner. More specifically, at the back of the roller assembly 10 there are a number of upper feed rollers 26*a* which engage the paper from the cross-over rollers (not shown) and feed the paper down into the dryer tank 12. Furthermore, at the front of the roller assembly 10, there are provided a number additional feed rollers 26*b* which retrieve the paper as it moves in an upward direction from the tank and feed it to a downstream location (not shown) external to the drying tank.

Figure 2:
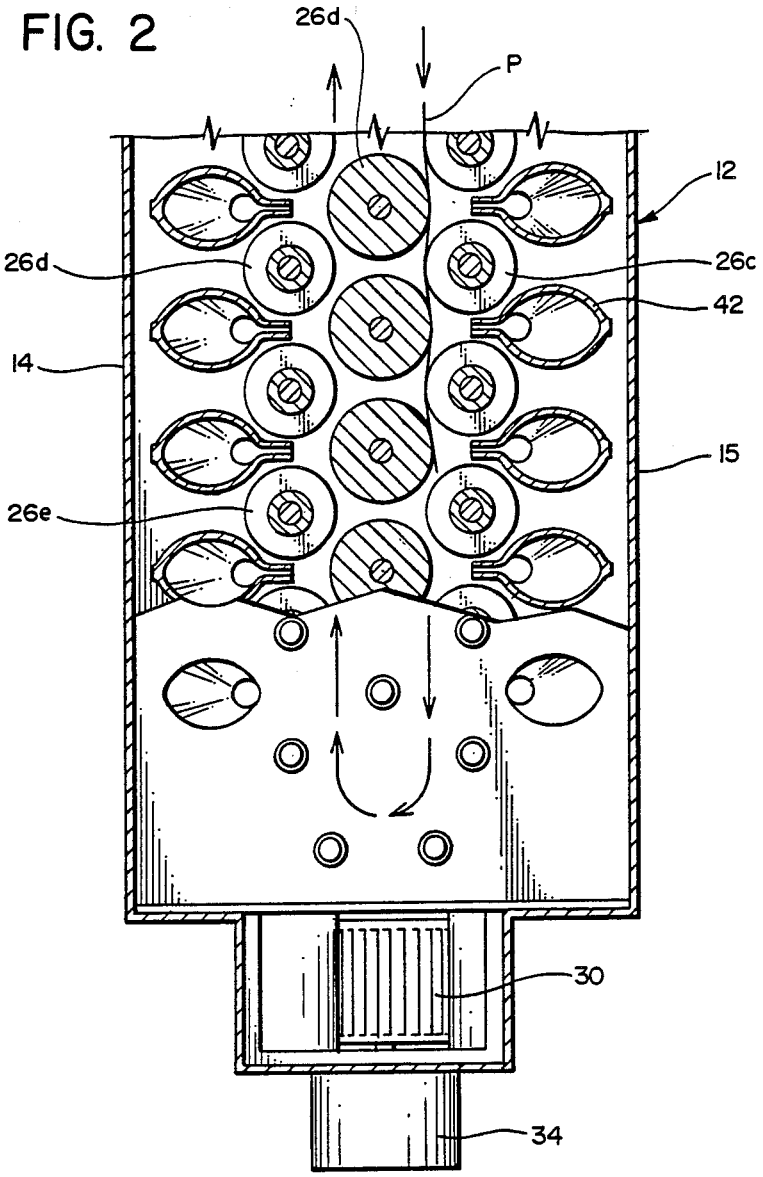
FIG. 2 is a end sectional view of the dryer assembly of the present invention taken along lines 2—2 of FIG. 3.
Figure 3:
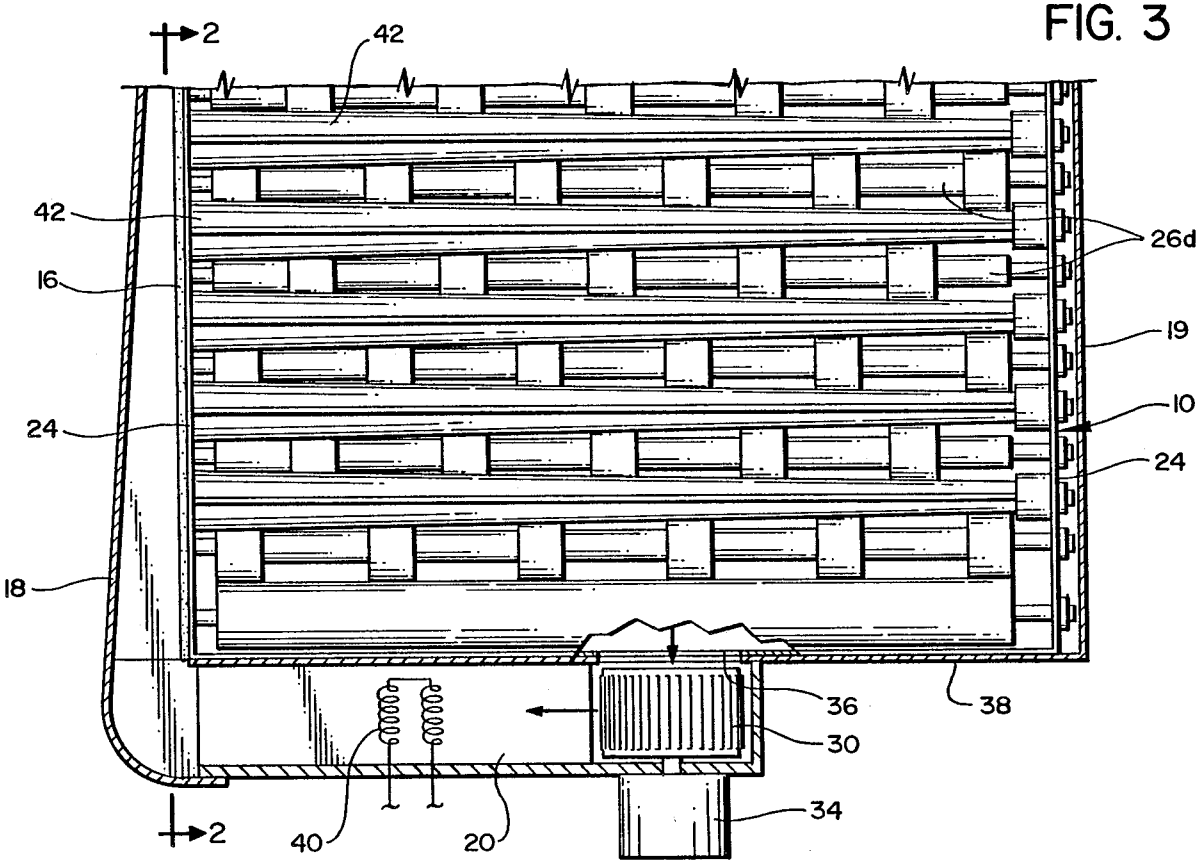
FIG. 3 is a front sectional view of the dryer assembly of the present invention.

The path of the paper inside the drying tank 12 is shown more clearly in FIG. 2. That is, the paper, identified by the letter "P", is engaged by the rear feed rollers and caused to move in a downward direction at the rear of the tank until reaching a location near the bottom of the tank where it is reversed and fed upwards toward the top of the tank, to be retrieved by the front feed rollers and discharged.

As shown by FIGS. 2 and 3, the paper is transported downward in the drying tank between a number of rear transport rollers 26*c* and central rollers 26*d*. More specifically, the central rollers 26*d*, which are located midway between the front 14 and the rear walls 15 of the tank, extend in a lengthwise direction between side flanges 24. Furthermore, these central rollers 26*d* are spaced one above the other between the top and bottom of the tank.

Transporation of the paper downward in the tank is assisted by the rear rollers 26*c* (FIG. 2) which are located parallel to central rollers 26*d* and each of which is offset slightly rearward of and intermediate to a pair of adjacent upper and lower central rollers 26*d*.

Similarly, engagement and transportation of the paper upwards in the tank is accomplished by a plurality of forward rollers 26*e* which are parallel to the rollers 26*a* through *d*, and each of which is offset slightly forward of and intermediate to a pair of adjacent upper and lower rollers 26*d*.

Drying of the paper is accomplished by blowing warm air against the surface of the paper to promote both distribution and evaporation of the chemicals remaining on the paper. The air is distributed throughout the tank by means of a lower rotary air pump 30 (FIG. 3) which is located inside the lower duct 20 at the bottom of the tank and which is driven by an electrical motor 34. Air is withdrawn from the tank through an opening 36 in a floor 38 of the tank and pulled down into the pump 30 where it is discharged laterally along the lower duct 20 and past an electrical resistance heater 40 located inside the duct 20. Upon reaching the left end of the duct 20, the air is directed upward in the tank by the side ducts 18. As shown by FIG. 3, the tank floor 38 supports the removable roller assembly above the pump 30 and lower duct 20.

Distribution of the heated air against the surface of the paper is accomplished by a number of distribution ducts 42 (FIGS. 2 and 3) which extend in a lengthwise manner parallel to the rollers 26, and which are connected to the left, right side flanges 24 of the roller assembly.

Figure 5:
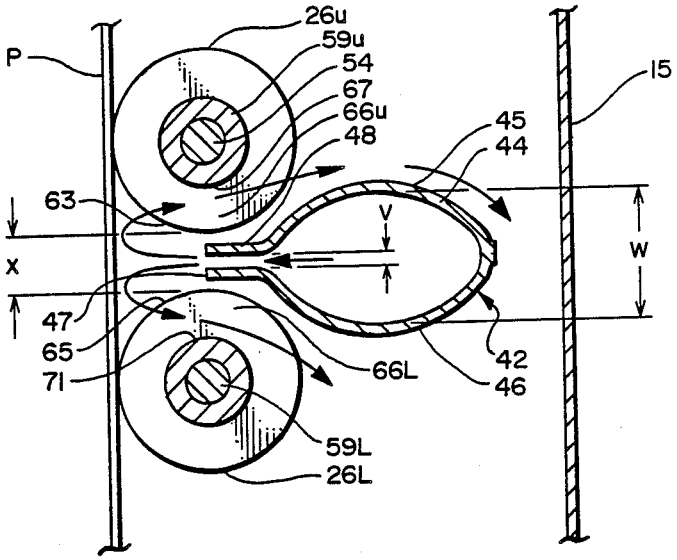
FIG. 5 is a partial end sectional view of one dryer nozzle which is intermediate the upper and lower paper transport rollers.

As shown more clearly in FIG. 5, each distribution duct 42 includes a tube portion 44 which has a somewhat convexly shaped upper surface 45 which is integrally joined at its ends to a somewhat convexly shaped lower surface 46; surfaces 45, 46 forming a structure whose cross-section is elliptical in shape. Discharge of the air from the duct 42 is accomplished by a discharge chute 47 which is integrally connected to the left side (in FIG. 5) of the tube portion 44. The discharge chute includes upper and lower horizontal flanges 48 which are separated by a vertical dimension V which is narrow relative to the largest vertical dimension W (FIG. 5) of the tube portion 44 so as to accelerate the air in a leftward horizontal direction toward the paper. In addition, the vertical dimension V of the chute 47 is less than a vertical dimension X (FIG. 5) between the surfaces of adjacent upper and lower front or rear rollers 26 to permit the chute to be inserted between the adjacent upper and lower rollers at a short distance from the paper.

It should be appreciated that it is important to achieve a relatively high airflow output against the paper in order to maximize dispersion and drying of the chemicals on the paper. By inserting the chute 47 between adjacent upper and lower rollers 26, the distance between the discharge end of the chute and the paper is minimized in order to maximize the discharge velocity against the paper.

Since the only propelling force to the air is provided by the pump 30, it is important that a recirculating air path be provided which returns the air to the pump with a minimum loss of energy. It is known that any turbulence created in the recirculated air results in loss of energy and a lower discharge velocity. In order to minimize the loss of energy as the recirculated air is deflected from the paper, the arcuate upper and lower surfaces 45, 46 of the tube are provided. More specifically, the upper and lower surfaces are smoothly contoured to redirect the air reflected from the paper P across the distribution tube in a rightward direction (FIG. 5), and then downward as directed by the front 15 or rear walls 16 of the tank to form a return path to the inlet end of the pump.

Figure 4:
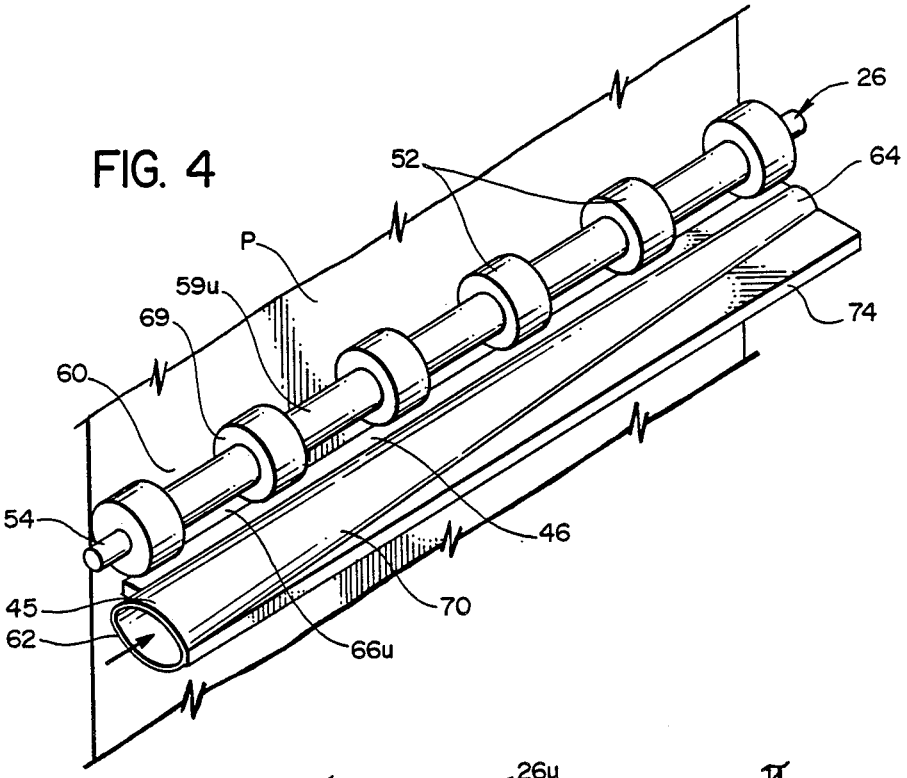
FIG. 4 is a partial isometric view showing a single row of paper transport rollers and a single dryer nozzle which together form a part of the dryer assembly.

Further improvement in minimizing the disruption of the air deflected from the paper is provided by utilizing segments 52 of the rollers 26 as shown in FIG. 4. That is, there are mounted on each roller shaft 54 a plurality of individual cylindrical roller segments 52 which are spaced apart by means of spacer collars 59 (mounted on the shaft 54) to provide air gaps 60 therebetween. These air gaps 60 provide outlet paths between the collars and the upper and lower surfaces of the discharge chute and tube to provide smooth and uninterrupted flow of the return air toward the front or rear walls of the tank.

More specifically, as shown in FIG. 5, the discharge chute 47 is positioned between the adjacent upper and lower rollers so that there is very little space remaining (1) between the upper surface of the discharge chute and the lower surface 63 of the upper roller 26*u*, and (2) between the lower surface of the discharge chute and the upper surface 65 of the lower roller 26L. However, by utilizing the segmented rollers 52, there are provided a plurality of upper air return outlets 66*u* (FIGS. 4 and 5), each of which is formed by (1) a combination of the upper surface of the discharge chute and the left portion of the tube upper surface 45, (2) the lower surface 67 of the upper collar 59*u*, and (3) opposing sides 69 (FIG. 4) of adjacent roller segments 52. In addition, a plurality of lower air return outlets 66L (FIG. 5) are formed by (1) a combination of the lower surface of the discharge chute and the left portion of the tube lower surface 46, (2) the upper surface 71 of the lower collar 59L, and (3) opposing sides 69 of adjacent roller segments 52.

In order to further sustain the flow of air along the length of the distribution duct, the left inlet end 62

(FIG. 4) of the tube (where it joins with the duct 18), has a larger cross sectional area than the opposite, right closed end 64 of the tube. More specifically, the cross-section of the distribution tube is smoothly tapered in decreasing manner from the left to the right. In this manner the velocity of the air along the length of the distribution tube is sustained in spite of a decrease in volume of the air as it travels the tube length.

Further reduction in air turbulence is accomplished by utilizing the air ducts 18 (FIG. 1) which have smoothly contoured edges. Furthermore, each air duct 18 has a cross sectional area which decreases in size as the duct extends upwardly so as to maintain the velocity of the air as it is propelled to the top of the tank. Each duct 18 further includes sides 68 which engage the flanges 24 and enclose the inlet ends 62 of the tubes In an exemplary emodiment shown in FIG. 4, the distribution tube outer surface 70 which is opposite the discharge chute 47, includes a horizontal fin 74 which extends outward therefrom and which increases in its width dimension as the tube cross sectional area decreases. This fin 74 provides additional rigidity to the tube and aids in attaching the tube to the side flanges 24.

What is claimed is:

1. Apparatus for transporting and drying photographic paper in a drying tank, the apparatus comprising:

a. roller means for transporting the paper inside the tank, the roller means including (i) first and second upper rollers which are supported on upper shaft means in a manner that the upper rollers are spaced apart so that the upper shaft means is exposed therebetween, and further that each of the upper rollers has a paper engaging surface which is located radially outward from the upper shaft means, and (ii) first and second lower rollers which are supported on lower shaft means in a manner that the lower rollers are spaced apart so that the lower shaft means is exposed therebetween, and further so that each of the lower rollers has a paper engaging surface which is located radially outward from the lower shaft means, with the paper engaging surfaces of the lower rollers being separated from the paper engaging surfaces of the upper rollers by a vertical gap;

b. air distribution means for directing air against the surface of the paper and for providing a return path for the air after the air has been deflected from the paper, the air distribution means including (1) pump means for propelling the air, and (2) duct means, in communication with the pump means, for directing the air from the pump means to locations inside the tank, the duct means including an air tube having a discharge chute which is positioned in the vertical gap between the upper and lower rollers for directing air from the air tube against the paper; and c. the duct means in combination with the roller means providing (i) an upper return outlet, which is formed by a upper surface of the discharge chute and a lower surface of the exposed portion of the upper shaft means, providing an upper path for the air which has been deflected from the paper for return to the pump means, and (ii) a lower return outlet, which is formed by a lower surface of the discharge chute and an upper surface of the exposed portion of the lower shaft means, providing a lower path for the air which has been deflected from the paper for return to the pump means.

2. The apparatus as set forth in claim 1 wherein:

a. the air tube includes a convexly shaped upper surface, and a convexly shaped lower surface;

b. a combination of the upper surface of the air tube and the upper surface of the discharge chute together with the exposed portion of the lower surface of the upper shaft means forming the upper air return outlet; and c. a combination of the lower surface of the air tube and the lower surface of the discharge chute together with the exposed portion of the upper surface of the lower shaft means forming the lower air return outlet.

3. The apparatus as set forth in claim 2 wherein:

a. first and second upper rollers have opposing upstanding side surfaces which extend between the upper shaft means and the paper engaging surfaces of the rollers; and b. the upper air return outlet is formed by the opposing sides of the first and second upper rollers as well as by the upper surfaces of the discharge chute and air tube, and the lower surface of the exposed portion of the upper shaft means.

4. The apparatus as set forth in claim 3 wherein the discharge chute is formed by upper and lower substantially parallel flange members which are spaced apart a distance which is less than the vertical gap to permit the positioning of the discharge chute between the paper engaging surfaces of the upper and lower rollers at a location proximate to the paper.

* * * * *